US012742557B2

(12) United States Patent
Zhou

(10) Patent No.: US 12,742,557 B2
(45) Date of Patent: Sep. 22, 2026

(54) WINDOW AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventor: Junhua Zhou, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 605 days.

(21) Appl. No.: 17/749,395

(22) Filed: May 20, 2022

(65) Prior Publication Data

US 2022/0275950 A1 Sep. 1, 2022

Related U.S. Application Data

(63) Continuation of application No. PCT/CN2020/073007, filed on Jan. 19, 2020.

(30) Foreign Application Priority Data

Nov. 28, 2019 (CN) ..... 201922096577.8
Nov. 28, 2019 (CN) ..... 201922119570.3

(51) Int. Cl.
*F24F 1/027* (2019.01)
*F24F 1/028* (2019.01)
(Continued)

(52) U.S. Cl.
CPC ..... *F24F 1/027* (2013.01); *F24F 1/028* (2019.02); *F24F 7/04* (2013.01); *F24F 13/20* (2013.01); *F24F 13/24* (2013.01)

(58) Field of Classification Search
CPC ..... F24F 7/08; F24F 7/06; F24F 7/04; F24F 1/027; F24F 1/028; F24F 13/20; F24F 13/22; F24F 13/24
See application file for complete search history.

(56) References Cited

U.S. PATENT DOCUMENTS 3,792,593 A 2/1974 Loos et al.
3,938,348 A * 2/1976 Rickert ..... F24F 1/027 62/262
(Continued)

FOREIGN PATENT DOCUMENTS

CN 202254004 U 5/2012
CN 105805845 A 7/2016
(Continued)

OTHER PUBLICATIONS

International Search Report dated Aug. 20, 2020 received in International Application No. PCT/CN2020/073007 together with an English language translation.

*Primary Examiner* — Tavia Sullens
(74) *Attorney, Agent, or Firm* — Scully, Scott, Murphy & Presser, P.C.

(57) ABSTRACT

A window air conditioner is provided. The window air conditioner has a housing, an indoor air duct shell, an outdoor air duct shell and a fresh air duct shell. The housing has an indoor air inlet and an indoor air outlet communicated by an indoor air duct formed by the indoor air duct shell. The housing also has an outdoor air inlet and an outdoor air outlet communicated by an outdoor air duct. A fresh air opening communicated with the indoor air duct is provided on the back surface of the indoor air duct shell. The outdoor air duct shell forms a high-pressure area of the outdoor air duct and has a vent for an airflow in the high-pressure area of the outdoor air duct to pass. The fresh air duct shell has
(Continued)

a fresh air duct communicating the vent with the fresh air opening.

19 Claims, 7 Drawing Sheets

(51) Int. Cl.

| | |
|---|---|
| ***F24F 7/04*** | (2006.01) |
| ***F24F 13/20*** | (2006.01) |
| ***F24F 13/24*** | (2006.01) |

(56) References Cited

U.S. PATENT DOCUMENTS

| | | | | |
|---|---|---|---|---|
| 5,228,306 | A * | 7/1993 | Shyu | F24F 1/027 62/262 |
| 5,295,531 | A | 3/1994 | Tsunekawa et al. | |
| 2004/0168461 | A1* | 9/2004 | Park | F24F 1/027 62/262 |
| 2016/0313014 | A1* | 10/2016 | Phillips | F24F 1/027 |
| 2017/0115015 | A1* | 4/2017 | Beilfuss | F24F 1/027 |
| 2019/0154277 | A1* | 5/2019 | Jewell | F24F 1/027 |

FOREIGN PATENT DOCUMENTS

| | | | |
|---|---|---|---|
| CN | 106931533 | A | 7/2017 |
| CN | 109442571 | A | 3/2019 |
| JP | H06-2888 | A | 1/1994 |

* cited by examiner

WINDOW AIR CONDITIONER

The present application is a continuation application of PCT International Patent Application No. PCT/CN2020/073007, filed on Jan. 19, 2020, which claims priorities to and benefits of Chinese Patent Application Nos. 201922119570.3 and 201922096577.8, both filed on Nov. 28, 2019, the entire contents of which are incorporated herein by reference for all purposes. No new matter has been introduced.

FIELD

The present application relates to the field of air conditioners, and in particular, to a window air conditioner.

BACKGROUND

The traditional window air conditioner is equipped with an outdoor fan and an indoor fan inside its shell. The indoor fan is used to introduce the indoor air from the indoor air inlet to the indoor air duct, and then the air is blown out from the indoor air duct after heat exchange through the indoor heat exchanger. At the same time, the outdoor fan introduces the outdoor air from the outdoor air inlet to the outdoor air duct, and then the air is blown out from the outdoor air outlet after heat exchange by the outdoor heat exchanger.

In order to improve indoor air quality, the window air conditioners with fresh air function also become available in the market. This kind of window air conditioners with fresh air function is usually provided with a fresh air duct inside the housing, and a fresh air fan in the fresh air duct. The fresh air fan is used to introduce outdoor fresh air into the room. However, this will increase the number of fans inside the window air conditioner (i.e., the indoor fan, the outdoor fan and the fresh air fan existing at the same time), which is not conducive to saving the number of fans and increases the cost.

SUMMARY

The main purpose of the present application is to propose a window air conditioner, which aims to reduce the number of fans used in the window air conditioner and reduce the cost of fans.

In order to achieve the above purpose, the present application provides a window air conditioner, comprising:

a housing provided with an indoor air inlet, an indoor air outlet, an outdoor air inlet and an indoor air outlet; an indoor air duct and an outdoor air duct being provided inside the housing; the indoor air duct connecting the indoor air inlet with the indoor air outlet, and the outdoor air duct connecting the outdoor air inlet with the outdoor air outlet;

an indoor air duct shell provided in the housing to form the indoor air duct, and a back surface of the indoor air duct shell being provided with a fresh air opening communicated with the indoor air duct;

an outdoor air duct shell provided in the housing to form a high-pressure area of the outdoor air duct, and provided with a vent for an airflow in the high-pressure area of the outdoor air duct to pass; and a fresh air duct shell provided with a fresh air duct for communicating the vent with the fresh air opening.

Optionally, the outdoor air duct shell comprises an air duct back plate and air duct side plates extending obliquely backward from two sides of the air duct back plate respectively, and the vent is provided on one of the air duct side plates.

Optionally, the air duct side plate is convex with a sleeve part along an outer periphery of the vent, and the sleeve part is sleeved on an air duct inlet of the fresh air duct shell.

Optionally, a fresh air deflector is provided at the vent and rotatably connected with the fresh air duct shell, and an opening degree of the vent is adjustable through a rotation of the fresh air deflector.

Optionally, there is a plurality of fresh air deflectors, and the plurality of fresh air deflectors are switchable between an unfolded state and a closed state by rotation;

in the unfolded state, a ventilation gap is formed between two adjacent fresh air deflectors to open the vent; and in the closed state, the plurality of fresh air deflectors are spliced in turn to cover the vent.

Optionally, the fresh air deflector is connected with a motor to be driven to rotate; or the fresh air deflector is driven to rotate by the airflow blown out from the vent.

Optionally, the air duct back plate is provided with a fan mounting port; the window air conditioner further comprises an outdoor fan provided at the fan mounting port for driving the airflow from the high-pressure area of the outdoor air duct to a low-pressure area of the outdoor air duct.

Optionally, the window air conditioner further comprises a compressor provided in the housing and located between another air duct side plate of the outdoor air duct shell and an end of the indoor air duct shell.

Optionally, the window air conditioner further comprises an indoor heat exchanger and an outdoor heat exchanger; the indoor heat exchanger is provided in the indoor air duct and corresponds to the indoor air inlet; the outdoor heat exchanger is provided in the high-pressure area of the outdoor air duct and corresponds to the outdoor air inlet.

Optionally, the window air conditioner further comprises a dehumidification heat exchanger provided in the housing and corresponding to the fresh air opening.

Optionally, the compressor of the window air conditioner has an exhaust port and an air return port; the window air conditioner further comprises a first pipe connecting the exhaust port of the compressor, the outdoor heat exchanger and the indoor heat exchanger in turn, and a second pipe connecting the indoor heat exchanger and the air return port of the compressor, thereby forming a refrigerant circulation loop; and the window air conditioner further comprises a first branch pipe bifurcated from a junction of the first pipe and a second branch pipe bifurcated from the second pipe, the first branch pipe is connected with a refrigerant inlet end of the dehumidification heat exchanger, the second branch pipe is connected with a refrigerant outlet end of the dehumidification heat exchanger, and the junction is located between the outdoor heat exchanger and the indoor heat exchanger.

Optionally, the window air conditioner further comprises a switcher switchable between a first state and a second state, in the first state, the switcher communicates the exhaust port of the compressor with the first pipe, and communicates the air return port of the compressor with the second pipe; and in the second state, the switcher communicates the exhaust port of the compressor with the second pipe, and communicates the air return port of the compressor with the first pipe.

Optionally, the window air conditioner further comprises a first opening degree adjustment device provided on the first branch pipe; and/or, a second opening degree adjustment device provided on the first pipe and located between the junction of the first pipe and the indoor heat exchanger.

Optionally, the window air conditioner further comprises a dehumidification heat exchanger corresponding to the fresh air opening and provided inside the fresh air duct shell, or provided between the air duct outlet of the fresh air duct shell and the fresh air opening, or provided at the fresh air opening, or provided on an inner side of the fresh air opening.

Optionally, a holding position is formed between the air duct outlet of the fresh air duct shell and the fresh air opening, and the dehumidification heat exchanger is provided in the holding position.

Optionally, a windproof is extended from an upper edge of the air duct outlet of the fresh air duct shell towards a position above the dehumidification heat exchanger, and covers a top of the dehumidification heat exchanger.

Optionally, a protective edge plate is extended laterally from a side edge of the air duct outlet, and is of an L-shape and bent, a buckle groove of an L-shape is provided between the protective edge plate and the windproof, a back edge of an end plate of the dehumidification heat exchanger is provided with a flange fitting the buckle groove and plugged in the buckle groove.

Optionally, a ventilation area of the air duct outlet of the fresh air duct shell is greater than that of the air duct inlet of the fresh air duct shell.

Optionally, the fresh air duct is divided into an air guide section and an air outlet section along a flow direction of fresh air, and the air guide section is gradually expanded from the air duct inlet to the air outlet section.

Optionally, the fresh air duct shell has a first side wall and a second side wall located on opposite sides of the air guide section, the second side wall is close to a side plate of the housing, and a wall surface of the second side wall is in an arc shape from the air duct inlet to the air outlet section.

Optionally, the window air conditioner further comprises a fresh air grid provided in the fresh air opening, and the fresh air grid is inclined from top to bottom towards the inner side of the fresh air opening.

In the technical solution of the present application, a fresh air outlet communicated with the indoor air duct is provided in the indoor air duct shell, and a vent communicated with the high-pressure area of the outdoor air duct is provided in the outdoor air duct shell. The fresh air duct of the fresh air duct shell is used to communicate the vent and the fresh air opening, so as to make use of the high-pressure of the high-pressure area of the outdoor air duct to drive the outdoor air to flow to the fresh air duct, so that there is no need to set a fresh air fan in the fresh air duct.

BRIEF DESCRIPTION OF THE DRAWINGS

In order to more clearly explain the embodiments of the present application or the technical solutions in the related art, the following will briefly introduce the drawings in the embodiments or the description of the related art. It is obvious that the drawings in the following description are only some embodiments of the present application. For those skilled in the art, other drawings can be obtained according to the structure shown in these drawings without paying creative labor.

Figure 1:
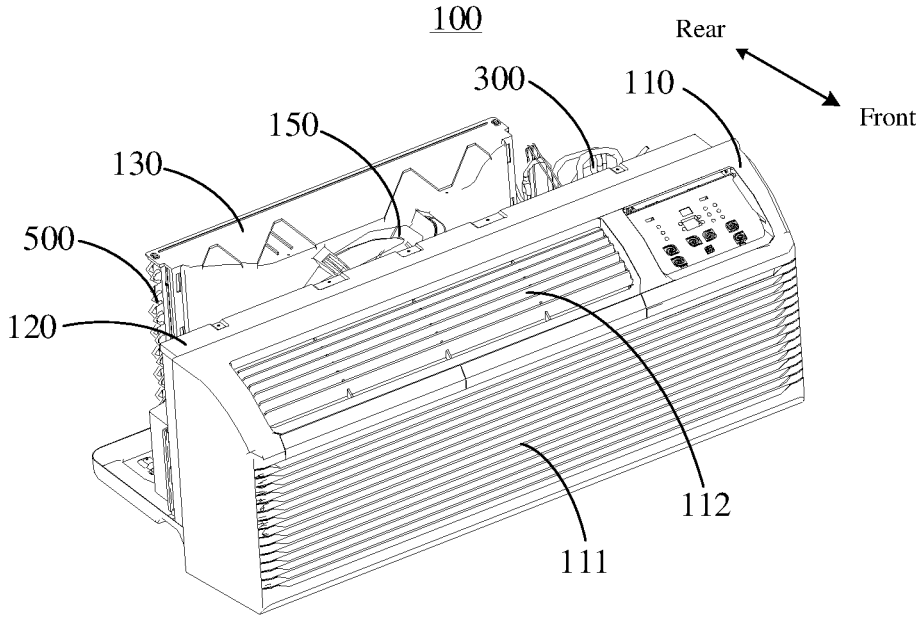
FIG. 1 is a partial structural view of a window air conditioner according to an exemplary embodiment of the present application.

Reference numerals shown in the figures are described in the following table.

| label | name |
|---|---|
| 100 | window air conditioner |
| 110 | housing |
| 111 | indoor air inlet |
| 112 | indoor air outlet |
| 120 | indoor air duct shell |
| 121 | fresh air opening |
| 130 | outdoor air duct shell |
| 131 | air duct back plate |
| 132 | air duct side plate |
| 1301 | vent |
| 1302 | fan mounting port |
| 1303 | sleeve part |
| 140 | indoor fan |
| 150 | outdoor fan |
| 160 | fresh air deflector |
| 170 | fresh air grid |
| 200 | fresh air duct shell |
| 210 | fresh air duct |
| 211 | air guide section |
| 212 | air outlet section |
| 220 | first side wall |
| 230 | second side wall |
| 240 | third side wall |
| 250 | windproof |
| 260 | protective edge plate |
| 201 | air duct inlet |
| 202 | air duct outlet |
| 300 | compressor |
| 310 | exhaust port |
| 320 | air return port |
| 400 | indoor heat exchanger |
| 500 | outdoor heat exchanger |
| 600 | dehumidification heat exchanger |
| 610 | end plate |
| 611 | flange |
| 10 | first pipe |
| 11 | cross-point |
| 20 | second pipe |
| 30 | first branch pipe |
| 40 | second branch pipe |
| 50 | switcher |

-continued

| label | name |
|---|---|
| 60 | first opening degree adjustment device |
| 70 | second opening degree adjustment device |
| 80 | flow direction adjustment device |
| 90 | refrigerant radiator |

The realization of the purpose, functional features and advantages of the present application will be further described with reference to the attached drawings in combination with the embodiments.

DETAILED DESCRIPTION OF EMBODIMENTS

The technical solution in the embodiment of the present application will be clearly and completely described below in combination with the accompanying drawings in the embodiment of the present application. Obviously, the described embodiments are only part of the embodiments of the present application, not all of the embodiments. Based on the embodiments in the present application, all other embodiments obtained by ordinary technicians in the art without creative work belong to the scope of protection of the present application.

It should be noted that if the embodiment of the present application involves a directional indication (such as up, down, left, right, front, back . . . ), the directional indication is only used to explain the relative position relationship and movement among components in a specific attitude (as shown in the attached drawings). If the specific attitude changes, the directional indication will change accordingly.

In addition, if there is a description of "first", "second" and so on in the embodiment of the present application, the description of "first", "second" and so on is only for the purpose of description, and cannot be understood as indicating or implying its relative importance or implicitly indicating the number of indicated technical features. Thus, the features defined with "first" and "second" may include at least one of the features explicitly or implicitly. In addition, the technical solutions among various embodiments can be combined with each other, but it must be based on the realization of those skilled in the art. When the combination of technical solutions is contradictory or impossible, it shall be considered that the combination of technical solutions does not exist and is not within the protection scope of the present application.

The present application provides an embodiment of a window air conditioner. The window air conditioner integrates an indoor unit and an outdoor unit into one. The whole window air conditioner is provided on a window of a building to realize cooling or heating of an indoor environment. In addition, the window air conditioner can introduce outdoor fresh air into indoors, and use a smaller number of fans, thereby saving the cost of fans. Certain embodiments of the window air conditioner will be described below.

Figure 2:
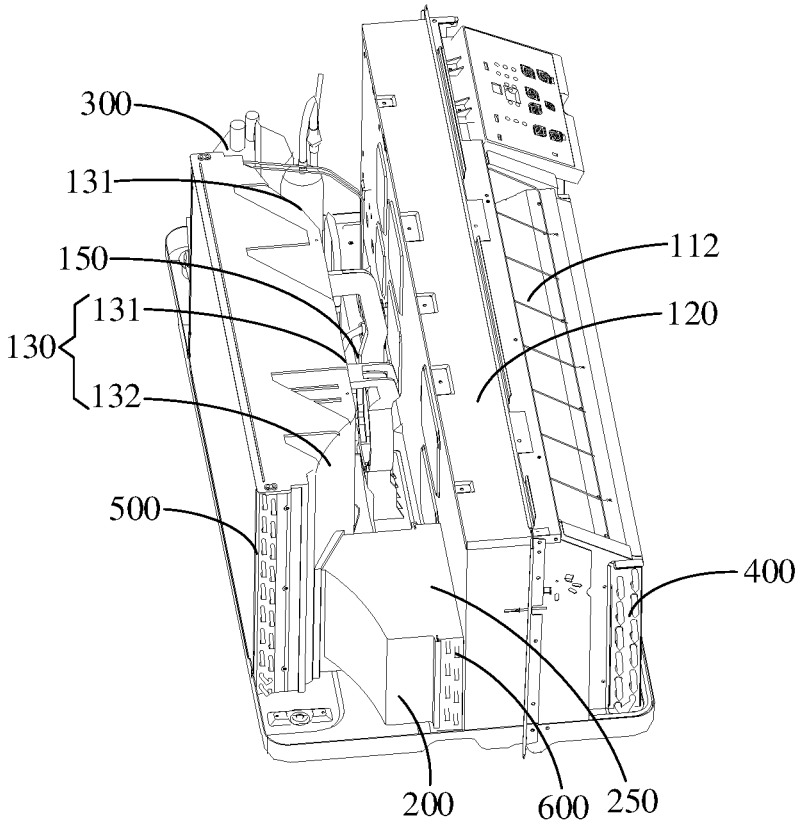
FIG. 2 is a side view of the window air conditioner in FIG. 1.

Referring to FIGS. 1 and 2, in an exemplary embodiment of the window air conditioner of the present application, the window air conditioner 100 includes a housing 110, an indoor air duct shell 120, an outdoor air duct shell 130 and a fresh air duct shell 200. The housing 110 is provided with an indoor air inlet 111, an indoor air outlet 112, an outdoor air inlet and an outdoor air outlet (not shown in the figures). An indoor air duct and an outdoor air duct are provided inside the housing 110, the indoor air duct communicates the indoor air inlet 111 with the indoor air outlet 112, and the outdoor air duct communicates the outdoor air inlet with the indoor air outlet.

The indoor air duct shell 120 is provided in the housing 110 to form the indoor air duct. A rear side of the indoor air duct shell 120 is provided with a fresh air opening 121 communicated with the indoor air duct (referring to FIG. 6 for the fresh air opening 121).

The outdoor air duct shell 130 is provided in the housing 110 to form a high-pressure area of the outdoor air duct. The outdoor air duct shell 130 is also provided with a vent 1301 for the passing of the airflow in the high-pressure area of the outdoor air duct (refer to FIG. 7 and FIG. 8 for the vent 1301).

The fresh air duct shell 200 forms a fresh air duct communicating the fresh air opening 121 with the vent 1301.

For example, the housing 110 includes a chassis and a housing body provided on the chassis, and the housing body has a front surface, a back surface, a side surface and a top surface. The front surface of the housing body is provided with the indoor air inlet 111, and a front end of the top surface of the housing body is provided with the indoor air outlet 112. The back surface of the housing body is provided with the outdoor air inlet, and the side surface of the housing body is provided with the outdoor air outlet. The high-pressure area of the outdoor air duct is formed inside the outdoor air duct shell 130, and the high-pressure area of the outdoor air duct is communicated with the outdoor air inlet. A negative pressure area of the outdoor air duct is formed in a space between the outdoor air duct shell 130 and the indoor air duct shell 120, and the negative pressure area of the outdoor air duct is communicated with the indoor air outlet.

Figure 9:
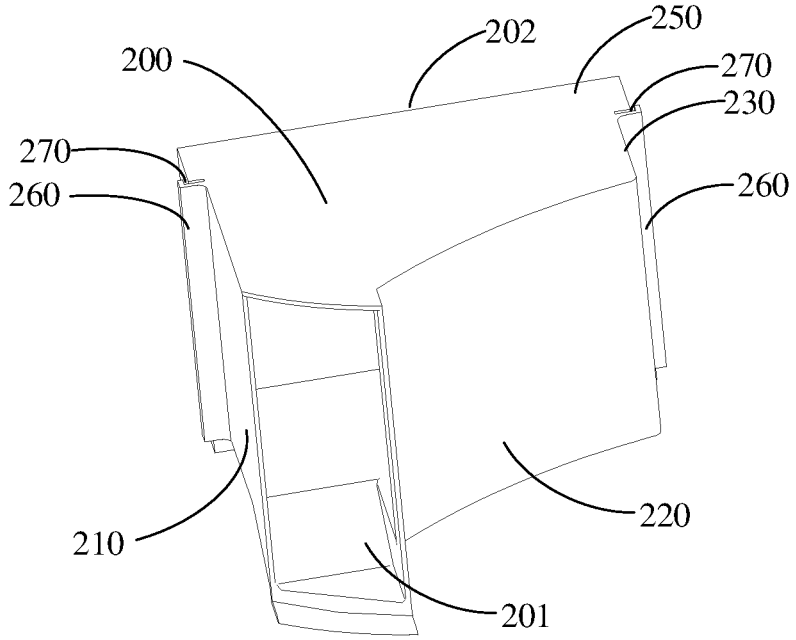
FIG. 9 is the structural view of the fresh air duct shell in FIG. 2.

The fresh air duct formed inside the fresh air duct shell 200 has an air duct inlet 201 and an air duct outlet 202 (shown in FIG. 9). The air duct inlet 201 is communicated with the vent 1301 on the outdoor air duct shell 130, and the air duct outlet 202 is communicated with the fresh air opening 121. Compared with the high-pressure area of the outdoor air duct, the fresh air duct is a negative-pressure area. Therefore, when the outdoor air enters the high-pressure area of the outdoor air duct from the outdoor air inlet, under the action of high pressure, the outdoor airflows into the fresh air duct of the fresh air duct shell 200 through the vent on the outdoor air duct shell 130, then enters the indoor air duct through the fresh air duct and the fresh air opening of the indoor air duct shell 120, and finally is blown out of the indoor air duct to the room through the indoor air outlet. In other words, the high-pressure of the high-pressure area of the outdoor air duct drives the outdoor air to flow to the fresh air duct, and thus there is no need to provide a fresh air fan in the fresh air duct.

Referring also to FIGS. 1 and 2, the window air conditioner 100 also includes an indoor heat exchanger 400 and an outdoor heat exchanger 500. The indoor heat exchanger 400 is provided in the indoor air duct and corresponds to the indoor air inlet 111. The outdoor heat exchanger 500 is provided in the high-pressure area of the outdoor air duct and corresponds to the outdoor air outlet. For example, the indoor heat exchanger 400 is close to the front surface of the housing body to correspond to the indoor air inlet 111. The outdoor heat exchanger 500 is close to the back surface of the housing to correspond to the outdoor air inlet.

The window air conditioner 100 also includes an indoor fan 140 and an outdoor fan 150. The indoor fan 140 is provided in the indoor air duct to drive the air to enter the indoor air duct from the indoor air outlet, and then the air is blown out from the indoor air outlet 112. The outdoor fan 150 is provided in the outdoor air duct, the outdoor fan 150 works to generate a high air pressure in the high-pressure area of the outdoor air duct, which can drive the air from the outdoor air into the high-pressure area of the outdoor air duct. One portion of the air is further driven by the outdoor fan 150 to flow to the negative pressure area of the outdoor air duct, and finally this portion of the air is blown out from the outdoor air outlet. The other portion of the airflows to the fresh air duct through the vent 1301, then enters the indoor air duct through the fresh air opening, and finally is blown out from the indoor air outlet.

Figure 3:
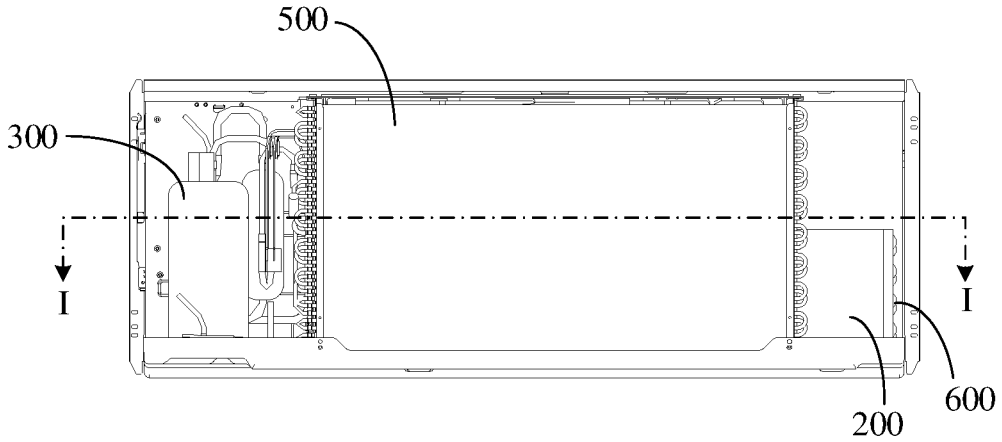
FIG. 3 is a back view of the window air conditioner in FIG. 1.
Figure 4:
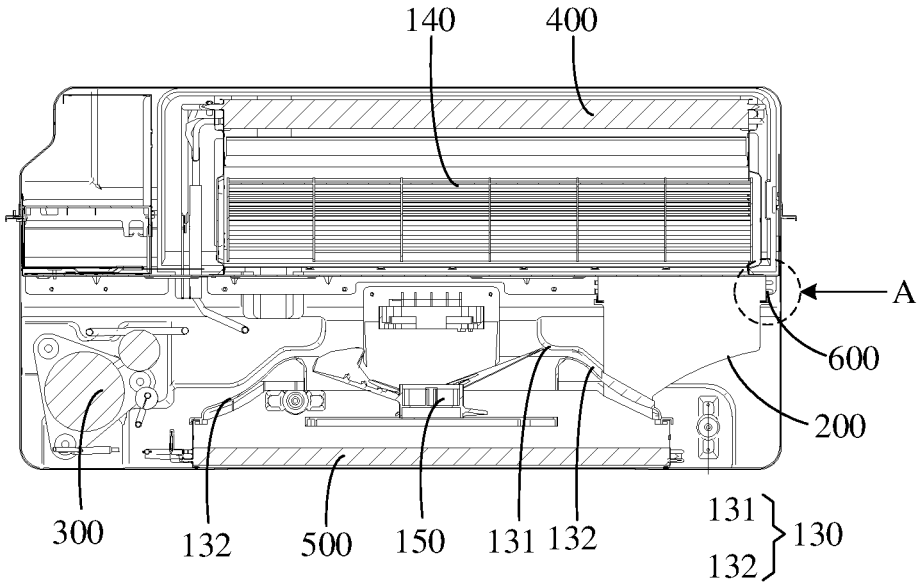
FIG. 4 is a sectional view along I-I in FIG. 3.

Referring to FIGS. 2 to 4, through the cooperation of the internal components of the window air conditioner 100, the window air conditioner 100 can realize a variety of working modes, including but not limited to: a cooling mode and/or a heating mode, a fresh air mode and other modes. The main working modes and principles are briefly described below:

In the cooling mode, the indoor fan 140 drives the indoor air from the indoor air inlet 111 into the indoor air duct, and the air becomes cold air after heat exchange through the indoor air duct, and the cold air is blown out to the room through the indoor air outlet 112 to realize indoor cooling or refrigeration. At the same time, the outdoor fan 150 drives the outdoor air to enter the outdoor air duct from the outdoor air inlet of the housing 110, and the air becomes hot air after heat exchange through the outdoor air duct, and the hot air is discharged to the outside through the outdoor air outlet.

In the heating mode, the indoor fan 140 drives the indoor air from the indoor air inlet 111 into the indoor air duct, the air becomes hot air after heat exchange through the indoor air duct, and the hot air is blown out to the room through the indoor air outlet 112 to realize indoor heating. At the same time, the outdoor fan 150 drives the outdoor air from the outdoor air inlet of the housing 110 into the outdoor air duct, the air becomes cold air after heat exchange through the outdoor air duct, and the cold air is discharged to the outside through the outdoor air outlet.

It should be noted that in the above cooling mode or heating mode, it is necessary to close the fresh air duct to avoid airflow between the hot air (or cold air) of the indoor air duct and the cold air (or hot air) of the outdoor air duct and reduce the effect of cooling or heating. The fresh air duct will be opened only when fresh air is required. In the fresh air mode, only the outdoor fan can be started and the refrigerant circulation system including the outdoor heat exchanger and the indoor heat exchanger is not started.

According to the technical solution of the present application, a fresh air opening 121 communicated with the indoor air duct is provided in the indoor air duct shell 120, and a vent 1301 communicated with the high-pressure area of the outdoor air duct is provided in the outdoor air duct shell 130. The fresh air duct of the fresh air duct shell 200 is configured to communicate the vent with the fresh air opening 121, so as to use the high-pressure of the high-pressure area of the outdoor air duct to drive the outdoor air to flow to the fresh air duct. Thus, there is no need to set a fresh air fan in the fresh air duct.

Referring to FIGS. 2 to 4, in the above embodiment, it is considered that when the outdoor ambient air humidity is high (such as the rain and fog weather or morning and evening condensation time period), introducing the air with high outdoor humidity directly into the indoor environment will further increase the humidity of the indoor environment and make users feel uncomfortable. At least for this purpose, the window air conditioner 100 may also include a dehumidification heat exchanger 600 provided in the housing 110 and corresponding to the fresh air opening 121 (referring to FIG. 6 for the fresh air opening 121), so as to dehumidify the fresh air with the dehumidification heat exchanger 600. That is, the window air conditioner 100 may also have a fresh air dehumidification mode. The working principle of the fresh air dehumidification mode will be described as follows.

In the fresh air dehumidification mode, the outdoor heat exchanger 500 heats and the dehumidification heat exchanger 600 cools. The fresh air entering from the outdoor air inlet is first heated by the outdoor heat exchanger 500 in the outdoor air duct to become hot air. One portion of the hot air is guided by the outdoor fan 150 and blown out from the outdoor air outlet; the other portion of the hot air enters the fresh air duct from the outdoor air duct, and is cooled and dehumidified by the dehumidification heat exchanger 600 in the fresh air duct to become dry fresh air. Finally, the dry fresh air is blown out from the indoor air outlet 112 through the indoor air duct (at this time, the indoor heat exchanger 400 can be started or not). It can be seen that in the process of fresh air entering the room from the outside, the fresh air is heated first, then cooled, mixed with the indoor air and then blown out, so as to achieve a constant temperature of the fresh air, that is, constant temperature dehumidification. In addition, after entering the indoor air duct, the dry fresh air can also be mixed with the indoor air entering from the indoor air inlet 111 to become a more uniform dry fresh air at ordinary temperature, so as to avoid the formation of two different airflows between indoor air and fresh air to the user, and improve the user's comfortable experience of using the window air conditioner 100.

For the dehumidification heat exchanger 600 corresponding to the fresh air opening 121, it is necessary to ensure that the fresh air enters the dehumidification heat exchanger 600 and passes through the dehumidification heat exchanger 600 when the fresh air enters the fresh air duct and passes through the indoor air duct to the indoor air outlet 112. In this regard, there may be a plurality of installation positions of the dehumidification heat exchanger 600.

In one embodiment, the dehumidification heat exchanger 600 may be provided inside the fresh air duct shell 200, that is, the whole dehumidification heat exchanger 600 is located in the fresh air duct. The dehumidification heat exchanger 600 can be located at the air duct inlet 201, the middle of the air duct or the air duct outlet 202 of the fresh air duct, which only needs to be opposite to the fresh air opening 121.

In another embodiment, the dehumidification heat exchanger 600 is provided between the air duct outlet 202 and the fresh air opening 121 of the fresh air duct shell 200. That is, the dehumidification heat exchanger 600 is located outside the air duct outlet 202 of the fresh air duct and also outside the fresh air opening 121. The dehumidification heat exchanger 600 should cover the periphery of the fresh air opening 121 to avoid the formation of an air leakage gap on the periphery of the fresh air opening 121.

In another embodiment, the dehumidification heat exchanger 600 is provided on the fresh air opening 121. At this time, the size of the dehumidification heat exchanger 600 fits that of the fresh air opening 121, and the periphery of the dehumidification heat exchanger 600 is matched and docked with the periphery of the fresh air opening 121, which can also allow the dehumidification heat exchanger 600 to cover the fresh air opening 121 and to reduce air leakage.

In another embodiment, the dehumidification heat exchanger 600 is provided on the inner side of the fresh air opening 121. That is, the dehumidification heat exchanger 600 is located on the inner side of the indoor air duct shell 120 and is spaced from the fresh air opening 121 by a short distance. At this time, an air leakage proof structure needs to be set between the periphery of the dehumidification heat exchanger 600 and the periphery of the fresh air opening 121 to prevent the fresh air from entering the indoor air duct directly without passing through the dehumidification heat exchanger 600.

Figure 6:
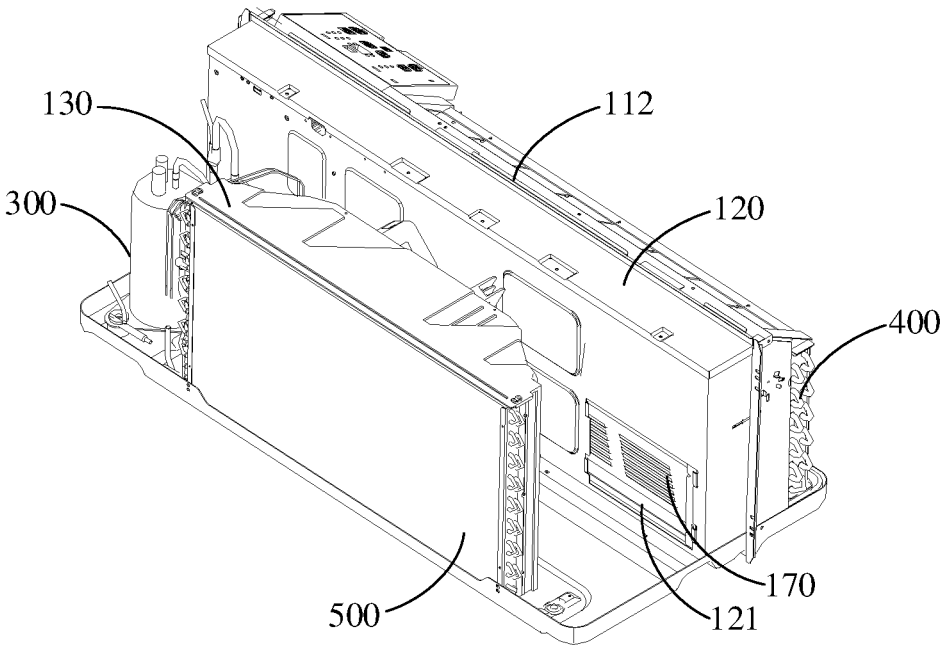
FIG. 6 is the structural view of the window air conditioner in FIG. 1 with a fresh air duct shell and a dehumidification heat exchanger removed.

Continuing to refer to FIGS. 2, 4 and 6, considering that the volume of fresh air duct shell 200 is typically small, it is not convenient to mount the dehumidification heat exchanger 600, since more components (such as, the indoor heat exchanger 400, the indoor fan 140, the electric control box, the volute, and etc.) need to be provided inside the indoor air duct shell 120. The available space for mounting the dehumidification heat exchanger 600 is small, and it is not convenient to mount the dehumidification heat exchanger 600. The volume of the outdoor heat exchanger 500 is usually smaller than that of the indoor heat exchanger 400, so that a large available space is formed between the outdoor air duct shell 130 and the indoor air duct shell 120 for mounting the dehumidification heat exchanger 600. Therefore, optionally, the air duct outlet 202 of the fresh air duct shell 200 is spaced from the fresh air opening 121, and the dehumidification heat exchanger 600 is provided between the air duct outlet 202 and the fresh air opening 121 of the fresh air duct shell 200.

Figure 5:
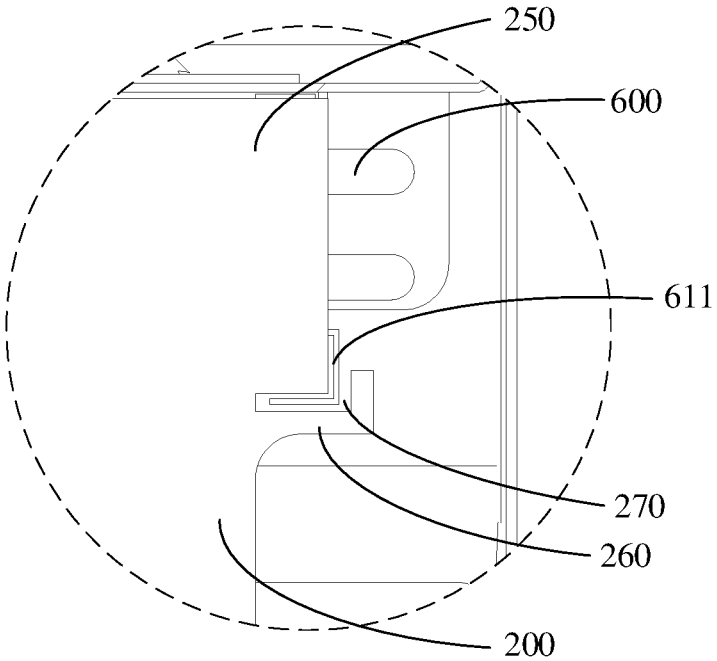
FIG. 5 is an enlarged view of portion A in FIG. 4.

Referring to FIG. 5, the window air conditioner 100 also includes a fresh air grid 170. The fresh air grid 170 is provided at the fresh air opening 121, and inclined from top to bottom towards the inner side of the fresh air opening 121. The fresh air can be dispersed by the fresh air grid 170 to mix evenly with the indoor air. The underlying reason for providing the inclined fresh air grid 170 is mainly the consideration that the outdoor fan 150 is provided with a water ring. When the water ring rotates to hit the water to spray to the outdoor heat exchanger 500, some water will splash on the fresh air opening 121. In order to avoid water splashing into the indoor air duct, the gaps on the fresh air grid 170 are inclined downward because the fresh air grid 170 is inclined, such that it is not easy for water droplets to drop to the gaps directly. The water droplets hitting the grid strips of the fresh air grid 170 can be easily dripped directly under its gravity and are not prone to being adhered to the grid strips.

Figure 7:
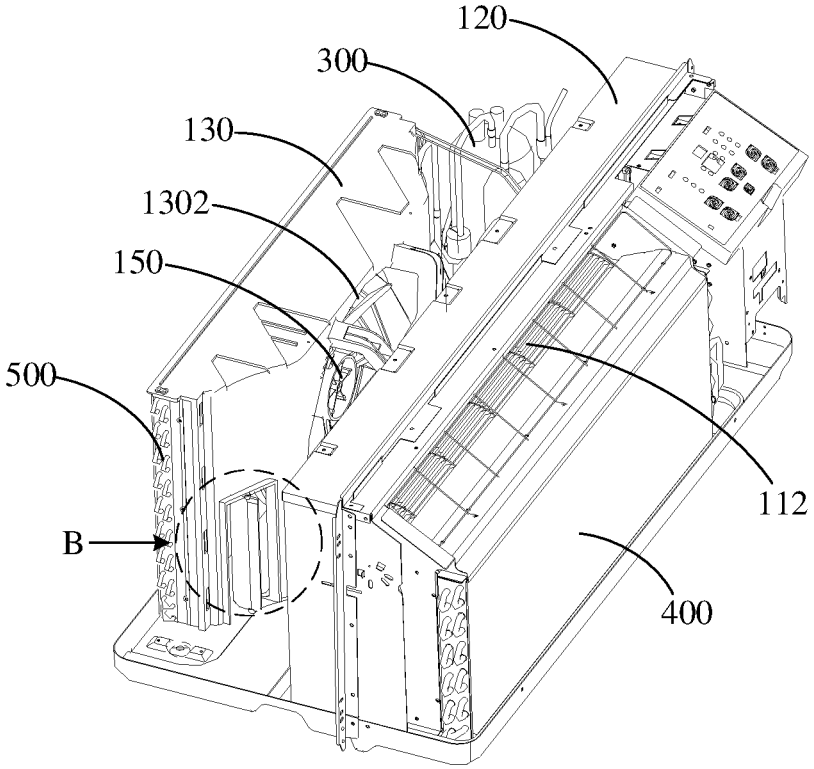
FIG. 7 is a structural view of the window air conditioner in FIG. 6, viewed from another a perspective.
Figure 8:
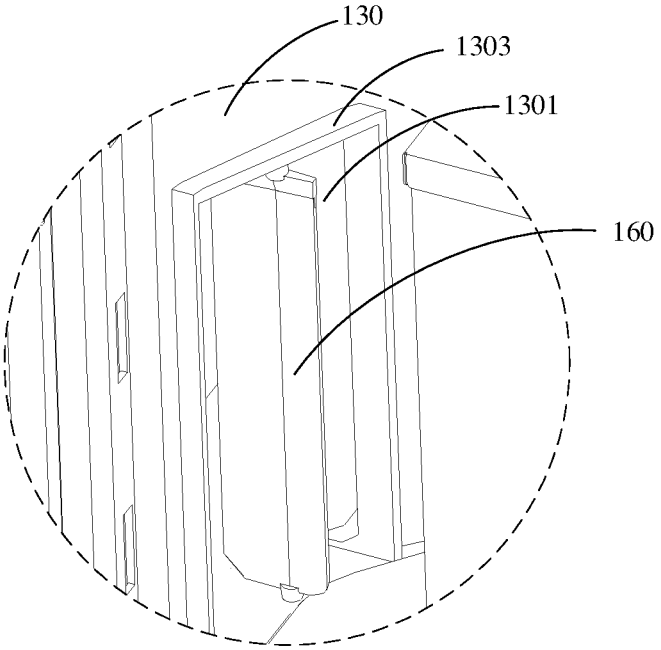
FIG. 8 is an enlarged view of portion B in FIG. 7.

Referring to FIGS. 2, 7 and 8, based on any of the above embodiments, due to a small spacing between the outdoor air duct shell 130 and the indoor air duct shell 120, it may not be enough to mount the fresh air duct shell 200. Since the outdoor air duct shell 130 includes an air duct back plate 131 and an air duct side plate 132 extending obliquely backward from both sides of the air duct back plate 131, the vent 1301 is provided on one of the air duct side plates 132. That is, the fresh air duct shell 200 is provided on one side of the outdoor air duct shell 130 and corresponds to the end of the indoor air duct shell 120, so as to effectively use the space between the air duct side plate 132 of the outdoor air duct shell 130 and the end of the indoor air duct shell 120.

Further, in order to facilitate the fresh air duct shell 200 docking with the vent 1301, optionally, the air duct side plate 132 is provided with a sleeve part 1303 along the outer periphery of the vent 1301. The sleeve part 1303 is used to sleeve on the air duct inlet of the fresh air duct shell 200. During assembly, the air duct inlet of the fresh air duct shell 200 is sleeved with the sleeve part 1303, and then the two can be connected and fixed by a bonding structure, a clamping structure or a screw structure.

In one embodiment, the window air conditioner 100 needs to be switched in different modes. For example, in the cooling mode or the heating mode, the fresh air duct needs to be closed. In the fresh air mode or fresh air dehumidification mode, the fresh air duct needs to be opened. In order to realize the switching between different modes, a fresh air deflector 160 is provided at the vent 1301. The fresh air deflector 160 is rotationally connected with the fresh air duct shell 200. An opening of the vent 1301 can be adjusted by rotation of the fresh air deflector 160.

When the fresh air deflector 160 is rotated to cover the vent 1301, an opening degree of the vent 1301 is zero or close to zero, so that the fresh air duct is closed. When the fresh air deflector 160 is rotated to expose the vent 1301, the opening degree of the vent 1301 is not zero, so that the fresh air duct is opened. At this time, the opening degree of the vent 1301 is increased by adjusting slightly the fresh air deflector 160, such that the wind direction of the fresh air deflector 160 can be adjusted.

For the driving mode of the fresh air deflector 160, the fresh air deflector 160 can be connected with a motor to be driven to rotate by the motor. Alternatively, the fresh air deflector 160 is driven to rotate by the airflow blown out from the vent 1301. In this way, the fresh air deflector 160 needs to be driven to return to the initial state through the elastic part. In order to facilitate the control of the state of the fresh air deflector 160, the above motor-driven mode is adopted here.

It is also considered here that if only one fresh air deflector 160 is designed, the volume of the whole fresh air deflector 160 is large, and a larger space for the rotation of the fresh air deflector 160 needs to be reserved inside and outside the vent 1301, resulting in a large space occupation, which is not conducive to the miniaturization of the window air conditioner 100. Therefore, there are designed a plurality of the fresh air deflectors 160, the plurality of fresh air deflectors 160 are provided at intervals, and the plurality of fresh air deflectors 160 are switchable between an unfolded state and a closed state through rotation. In the unfolded state, a ventilation gap is formed between two adjacent fresh air deflectors 160 to open the vent 1301. In the closed state, the plurality of fresh air deflectors 160 are spliced in turn to cover the vent 1301.

Compared with designing the fresh air deflector 160 as a whole plate body, due to the combination of the plurality of the fresh air deflectors 160, each fresh air deflector 160 can be designed smaller, so there is no need to reserve a large space for the rotation of the fresh air deflector 160 inside and outside the vent 1301, thereby reducing the space occupation, and contributing to the miniaturization of the window air conditioner 100.

Referring to FIG. 2 and FIG. 7, based on any of the above embodiments, for mounting the outdoor fan 150, the outdoor fan 150 can be provided inside the outdoor air duct shell 130, directly outside the outdoor air duct shell 130, or directly on the outdoor air duct shell 130. In an exemplary embodiment, the outdoor fan 150 is provided on the outdoor air duct shell 130. Due to the large radial size of the outdoor fan 150, it is not convenient to mount the outdoor fan 150 on the air duct side plate 132 of the outdoor air duct shell 130. Therefore, in order to facilitate mounting the outdoor fan 150, a fan mounting port 1302 is also provided on the air duct back plate 131 of the outdoor air duct shell 130. The outdoor fan 150 is provided at the fan mounting port 1302, and the outdoor fan 150 is suitable for driving the airflow from the high-pressure area of the outdoor air duct to the low-pressure area of the outdoor air duct.

Referring to FIGS. 2 and 4, in one embodiment, since a length of the indoor heat exchanger 400 is usually greater than that of the outdoor heat exchanger 500, a length of the indoor air duct shell 120 is usually designed to be longer and the outdoor air duct shell 130 is shorter, so that vacant areas are formed on both sides of the outdoor air duct shell 130. That is, a holding area is formed among one of the air duct side plates 132 of the outdoor air duct shell 130, one end of the indoor air duct shell 120 and one side plate of the housing 110. A holding area is also formed between the other air duct side plate 132 of the outdoor air duct shell 130, the other end of the indoor air duct shell 120 and the other air duct side plate 132 of the housing 110. One of the holding areas is for mounting the fresh air duct shell 200.

Based on this, the window air conditioner 100 also includes a compressor 300 provided in the housing 110 and located between another air duct side plate 132 of the outdoor air duct shell 130 and an end of the indoor air duct shell 120. That is, the compressor 300 is provided in another holding area to make full use of the internal space of the window air conditioner 100 and to improve a utilization rate of the space.

Figure 11:
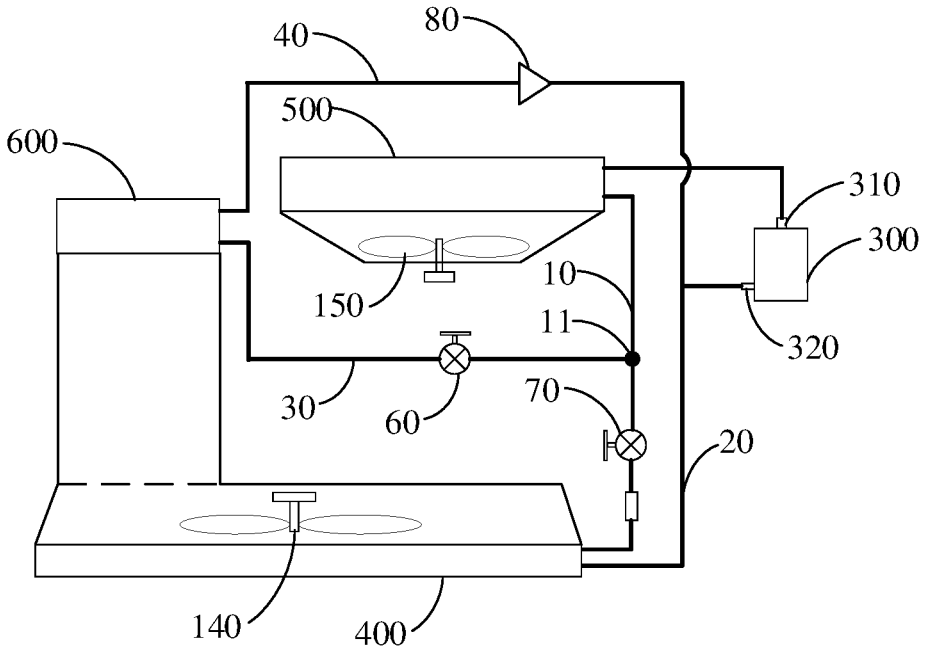
FIG. 11 is a schematic view of an embodiment of a refrigerant circulation system of the window air conditioner of the present application.

Referring to FIG. 11, in one embodiment, the compressor 300 of the window air conditioner 100 has an exhaust port 310 and an air return port 320. The window air conditioner 100 also includes a first pipe 10 connecting the exhaust port 310 of the compressor 300, the outdoor heat exchanger 500 and the indoor heat exchanger 400 in turn, and a second pipe 20 connecting the indoor heat exchanger 400 and the air return port 320 of the compressor 300, thereby forming a refrigerant circulation loop. The window air conditioner 100 also includes a first branch pipe 30 bifurcated from a junction 11 of the first pipe 10 and a second branch pipe 40 bifurcated from the second pipe 20. The first branch pipe 30 is connected with the refrigerant inlet end of the dehumidification heat exchanger 600, and the second branch pipe 40 is connected with the refrigerant outlet end of the dehumidification heat exchanger 600. The junction 11 is located between the outdoor heat exchanger 500 and the indoor heat exchanger 400.

In other words, the dehumidification heat exchanger 600 added to the window air conditioner 100 shares the compressor 300, the outdoor heat exchanger 500 and pipeline components (such as the first pipe 10 and the second pipe 20) with the original refrigerant circulation loop of the window air conditioner 100, without setting another set of refrigerant circulation system, thereby making the window air conditioner 100 more integrated and functional.

Figure 12:
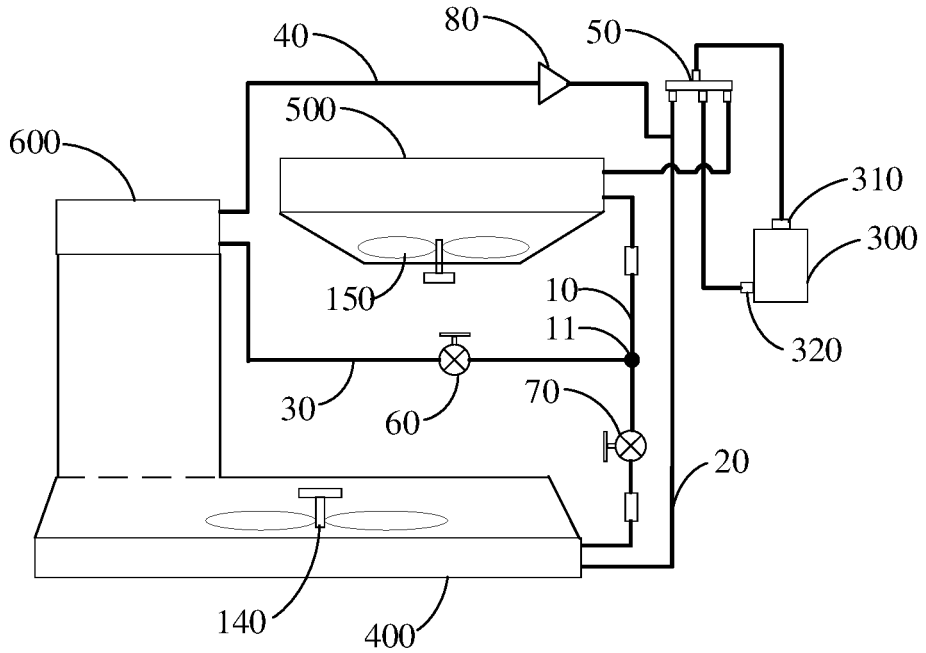
FIG. 12 is a schematic view of another embodiment of the refrigerant circulation system of the window air conditioner of the present application.

Referring to FIG. 12, in one embodiment, in order to realize that the window air conditioner 100 has both the cooling mode and the heating mode, and can switch between the cooling mode and the heating mode, optionally, the window air conditioner 100 also includes a switcher 50 switchable between the first state and the second state. In the first state, the switcher 50 communicates the exhaust port 310 of the compressor 300 with the first pipe 10, and communicates the air return port 320 of the compressor 300 with the second pipe 20. In the second state, the switcher 50 communicates the exhaust port 310 of the compressor 300 with the second pipe 20, and communicates the air return port 320 of the compressor 300 with the first pipe 10.

When the window air conditioner 100 starts the cooling mode, the switcher 50 is switched to the first state. The refrigerant flows from the exhaust port 310 of the compressor 300 to the first pipe 10, and firstly enters the outdoor heat exchanger 500 from the first pipe 10. After the refrigerant is liquefied to release heat (i.e., heating) in the outdoor heat exchanger 500, the liquefied refrigerant flows out of the outdoor heat exchanger 500, then enters the indoor heat exchanger 400 through the first pipe 10, and is evaporated to refrigerate in the indoor heat exchanger 400. Finally, the evaporated gaseous refrigerant flows out of the indoor heat exchanger 400 and returns to the compressor 300 through the second pipe 20 and the air return port 320 of the compressor 300.

When the window air conditioner 100 turns on the heating mode, the switcher 50 is switched to the second state. The refrigerant flows from the exhaust port 310 of the compressor 300 to the second pipe 20, and first enters the indoor heat exchanger 400 from the second pipe 20. After the refrigerant is liquefied to release heat (i.e. heating) in the indoor heat exchanger 400, the liquefied refrigerant flows out of the indoor heat exchanger 400, then enters the outdoor heat exchanger 500 through the first pipe 10, and is evaporated to refrigerate in the outdoor heat exchanger 500; finally, the evaporated gaseous refrigerant flows out of the outdoor heat exchanger 500 and returns to the compressor 300 through the first pipe 10 and the air return port 320 of the compressor 300.

Continuing to refer to FIG. 12, in order to switch the fresh air dehumidification mode and the above cooling mode or heating mode, the window air conditioner 100 also includes a first opening degree adjustment device 60 and a second opening degree adjustment device 70. The first opening degree adjustment device 60 is provided on the first branch pipe 30 for opening or closing the first branch pipe 30. The second opening degree adjustment device 70 is provided on the first pipe 10 and located between the junction 11 of the first pipe 10 and the indoor heat exchanger 400 for opening or closing the pipeline between the junction 11 of the first pipe 10 and the indoor heat exchanger 400. The window air conditioner 100 also includes a flow direction adjustment device 80 for adjusting an unidirectional flow of refrigerant from the dehumidification heat exchanger 600 to the second pipe 20.

When the window air conditioner 100 is in the aforementioned cooling mode or heating mode, the first opening degree adjustment device 60 is closed and the second opening degree adjustment device 70 is opened.

When the window air conditioner 100 turns on the fresh air dehumidification mode, the switcher 50 is switched to the first state, the first opening degree adjustment device 60 is opened and the second opening degree adjustment device 70 is closed. The refrigerant flows from the exhaust port 310 of the compressor 300 to the first pipe 10, and first enters the outdoor heat exchanger 500 from the first pipe 10. After the refrigerant is liquefied to release heat (i.e., heating) in the outdoor heat exchanger 500, the liquefied refrigerant flows out of the outdoor heat exchanger 500, then enters the dehumidification heat exchanger 600 through the first pipe 10 and the first branch pipe 30, and is evaporated to refrigerate in the dehumidification heat exchanger 600 for dehumidification of the dehumidification heat exchanger 600. Finally, the evaporated gaseous refrigerant flows out of the dehumidification heat exchanger 600 and returns to the compressor 300 through the second branch pipe 40 and the air return port 320 of the compressor 300.

The first opening degree adjustment device 60 and/or the second opening degree adjustment device 70 may be an on-off valve, a solenoid valve or other structure with a control pipeline switching function. The flow direction adjustment device 80 may be a check valve.

Figure 13:
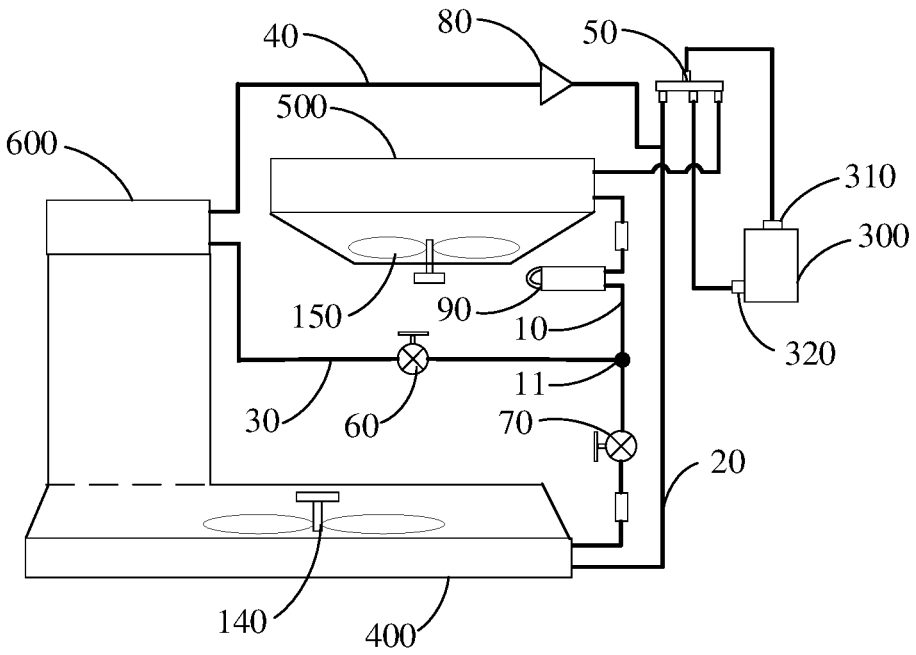
FIG. 13 is a schematic view of another embodiment of the refrigerant circulation system of the window air conditioner of the present application.

Continuing to refer to FIG. 13, in other embodiments, a refrigerant radiator 90 can be provided on the pipeline between the outdoor heat exchanger 500 and the junction 11 of the first pipe 10. The refrigerant radiator 90 can reduce the temperature of the electric control system and ensure the safety of the electric control system.

Referring to FIGS. 1 and 2, in an embodiment of the window air conditioner 100 of the present application, the window air conditioner 100 includes a housing 110, an indoor air duct shell 120, a fresh air duct shell 200 and a dehumidification heat exchanger 600. The housing 110 is provided with an indoor air inlet 111 and an indoor air outlet 112. The indoor air duct shell 120 is provided in the housing 110, the indoor air duct shell 120 is provided with an indoor air duct. The indoor air duct communicates the indoor air inlet 111 with the indoor air outlet 112, and the indoor air duct shell 120 is provided with a fresh air opening 121 communicated with the indoor air duct (referring to FIG. 6 for the fresh air opening 121). The fresh air duct shell 200 is provided in the housing 110. The fresh air duct shell 200 is provided with a fresh air duct 210 (referring to FIG. 10 for the fresh air duct 210). The fresh air duct 210 is suitable for communicating the fresh air opening 121 with the outdoor environment. The dehumidification heat exchanger 600 corresponds to the fresh air opening 121.

For example, the housing 110 includes a chassis and a housing body provided on the chassis, and the housing body has a front surface, a back surface, a side surface and a top surface. The front surface of the housing body is provided with an indoor air inlet 111, and the front end of the top surface of the housing body is provided with an indoor air outlet 112. The back surface of the housing body is provided with an outdoor air inlet, and the side surface of the housing body is provided with an outdoor air outlet. The window air conditioner 100 also includes an outdoor air duct shell 130 provided in the housing 110, and the outdoor air duct shell 130 is provided with an outdoor air duct communicating the outdoor air inlet with the indoor air outlet. The outdoor air duct is spaced from the indoor air duct.

Figure 10:
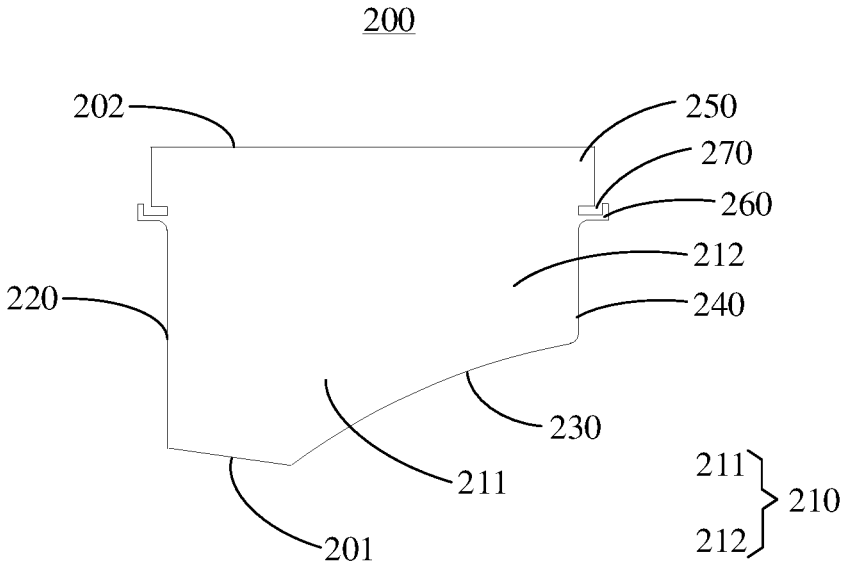
FIG. 10 is a top view of the fresh air duct shell in FIG. 9.

For the fresh air duct shell 200, the fresh air duct 210 is provided in the fresh air duct shell 200 and has an air duct inlet 201 and an air duct outlet 202 (see FIGS. 9 and 10). The air duct outlet 202 is communicated with the fresh air opening 121. The air duct inlet 201 can be directly communicated with the outdoor air duct to share the same outdoor air inlet with the outdoor air duct. Alternatively, an outdoor fresh air opening is additionally added on the back surface or side surface of the housing, and the air duct inlet 201 is communicated with the fresh air opening.

Referring to FIGS. 1 and 2, the window air conditioner 100 also includes an indoor heat exchanger 400 and an outdoor heat exchanger 500. The indoor heat exchanger 400 is provided in the indoor air duct and corresponds to the indoor air inlet 111. The outdoor heat exchanger 500 is provided in the outdoor air duct and corresponds to the outdoor air outlet. For example, the indoor heat exchanger 400 is close to the front surface of the housing to correspond to the indoor air inlet 111. The outdoor heat exchanger 500 is close to the back surface of the housing to correspond to the outdoor air inlet.

The window air conditioner 100 also includes an indoor fan 140 and an outdoor fan 150. The indoor fan 140 is provided in the indoor air duct to drive the air to enter the indoor air duct from the indoor air outlet, and subsequently blows out the air from the indoor air outlet 112. The outdoor fan 150 is provided in the outdoor air duct to drive the air to enter the outdoor air duct from the outdoor air, and subsequently blow out the air from the outdoor air outlet. It is worth mentioning that if the fresh air duct 210 is communicated with the high-pressure area of the outdoor air duct, the fresh air duct 210 and the outdoor air duct can share the same outdoor fan 150 to drive the air to flow. In addition, an independent fresh air fan can also be added in the fresh air duct 210 to drive the air to flow in the fresh air duct 210.

Referring to FIGS. 2 to 4, through the cooperation of the internal components of the window air conditioner 100, the window air conditioner 100 can realize a variety of working modes, such as but not limited to: a cooling mode and/or a heating mode, a fresh air mode, a fresh air dehumidification mode and other modes. The main working modes and principles will be briefly described as follows.

In the cooling mode, the indoor fan 140 drives the indoor air from the indoor air inlet 111 into the indoor air duct, and the air becomes cold air after heat exchange through the indoor air duct, and the cold air is blown out to the room through the indoor air outlet 112 to realize indoor refrigeration. At the same time, the outdoor fan 150 drives the outdoor air to enter the outdoor air duct from the outdoor air inlet of the housing 110, and the air becomes hot air after heat exchange through the outdoor air duct, and the hot air is discharged to the outside through the outdoor air outlet.

In the heating mode, the indoor fan 140 drives the indoor air from the indoor air inlet 111 into the indoor air duct, the air becomes hot air after heat exchange through the indoor air duct, and the hot air is blown out to the room through the indoor air outlet 112 to realize indoor heating. At the same time, the outdoor fan 150 drives the outdoor air from the outdoor air inlet of the housing 110 into the outdoor air duct, the air becomes cold air after heat exchange through the outdoor air duct, and the cold air is discharged to the outside through the outdoor air outlet.

In the fresh air dehumidification mode, the outdoor fan 150 or the fresh air fan drives the outdoor fresh air to into the fresh air duct 210. After heat exchange through the dehumidification heat exchanger 600, the water vapor in the fresh air is condensed and liquefied into condensate to be discharged, so that the humidity of the fresh air is reduced to form a relatively dry fresh air. The dry fresh air enters the indoor air duct through the fresh air opening 121, and then it is blown out to the room from the indoor air outlet 112 to realize fresh air dehumidification.

It is worth mentioning that if the fresh air duct 210 is communicated with the outdoor air duct to share the same outdoor air inlet, in the above fresh air dehumidification mode, the outdoor heat exchanger 500 heats and the dehumidification heat exchanger 600 cools. The fresh air entering from the outdoor air inlet is firstly heated by the outdoor heat exchanger 500 in the outdoor air duct to become hot air. One portion of the hot air is guided by the outdoor fan 150 and blown out from the outdoor air outlet; the other portion of the hot air enters the fresh air duct from the outdoor air duct, and is cooled and dehumidified by the dehumidification heat exchanger 600 in the fresh air duct to become dry fresh air. Finally, the dry fresh air is blown out from the indoor air outlet 112 through the indoor air duct (at this time, the indoor heat exchanger 400 can be started or not). It can be seen that in the process of fresh air entering the room from the outside, the fresh air is heated first, then cooled, mixed with the indoor air and then blown out, so as to achieve a constant temperature of fresh air, that is, constant temperature dehumidification.

In addition, after entering the indoor air duct, the dry fresh air can also be mixed with the indoor air entering from the indoor air inlet 111 to become more uniform dry fresh air at ordinary temperature, so as to avoid the formation of two different airflows between indoor air and fresh air to the user, and to improve the user's comfortable experience of using the window air conditioner 100.

In the technical solution of the present application, a fresh air duct shell 200 and a dehumidification heat exchanger 600 are provided in the housing 110. A fresh air duct 210 is provided in the fresh air duct shell 200, and is configured to communicate the fresh air opening 121 of the indoor air duct shell 120 with the outdoor environment. The dehumidification heat exchanger 600 corresponds to the fresh air opening 121, so that the dehumidification heat exchanger 600 can be used to dehumidify the fresh air during the introduction of the fresh air into the room through the fresh air duct 210, so as to avoid the increase of indoor air humidity caused by too wet fresh air, thereby improving the comfortable level of users using the window air conditioner 100.

Referring to FIGS. 2, 4 and 6, in the above embodiment, the dehumidification heat exchanger 600 corresponds to the fresh air opening 121. It is necessary to ensure that the fresh air enters the dehumidification heat exchanger 600 and passes through the dehumidification heat exchanger 600 when the fresh air enters the fresh air duct 210 and passes through the indoor air duct to the indoor air outlet 112. In this regard, there may be a plurality of installation positions of the dehumidification heat exchanger 600.

In one embodiment, the dehumidification heat exchanger 600 may be provided inside the fresh air duct shell 200, that is, the whole dehumidification heat exchanger 600 is located in the fresh air duct 210. The dehumidification heat exchanger 600 can be located at the air duct inlet 201, the middle of the air duct or the air duct outlet 202 of the fresh air duct, which only needs to be opposite to the fresh air opening 121.

In another embodiment, the dehumidification heat exchanger 600 is provided between the air duct outlet 202 and the fresh air opening 121 of the fresh air duct shell 200. That is, the dehumidification heat exchanger 600 is located outside the air duct outlet 202 of the fresh air duct and also outside the fresh air opening 121. The dehumidification heat exchanger 600 should cover the periphery of the fresh air opening 121 to avoid the formation of an air leakage gap on the periphery of the fresh air opening 121.

In another embodiment, the dehumidification heat exchanger 600 is provided on the fresh air opening 121. At this time, the size of the dehumidification heat exchanger 600 fits that of the fresh air opening 121, and the periphery of the dehumidification heat exchanger 600 is matched and docked with the periphery of the fresh air opening 121, which can also allow the dehumidification heat exchanger 600 to cover the fresh air opening 121 and to reduce air leakage.

In another embodiment, the dehumidification heat exchanger 600 is provided on the inner side of the fresh air opening 121. That is, the dehumidification heat exchanger 600 is located on the inner side of the indoor air duct shell 120 and is spaced from the fresh air opening 121 by a short distance. At this time, an air leakage proof structure needs to be set between the periphery of the dehumidification heat exchanger 600 and the periphery of the fresh air opening 121 to prevent the fresh air from entering the indoor air duct directly without passing through the dehumidification heat exchanger 600.

Continuing to refer to FIGS. 2, 4 and 6, considering that the volume of fresh air duct shell 200 is small, it is not convenient to mount the dehumidification heat exchanger 600, since more components (such as, the indoor heat exchanger 400, the indoor fan 140, the electric control box, the volute, etc.) need to be provided inside the indoor air duct shell 120. The available space for mounting dehumidification heat exchanger 600 is small, and it is not convenient to mount the dehumidification heat exchanger 600. The volume of the outdoor heat exchanger 500 is usually smaller than that of the indoor heat exchanger 400, so a large available space is formed between the outdoor air duct shell 130 and the indoor air duct shell 120 for mounting the dehumidification heat exchanger 600.

In view of this, the dehumidification heat exchanger 600 is provided between the air duct outlet 202 and the fresh air opening 121 of the fresh air duct shell 200. For example, a holding position is formed between the air duct outlet 202 of the fresh air duct shell 200 and the fresh air opening 121, and the dehumidification heat exchanger 600 is provided in the holding position. The dehumidification heat exchanger 600 can be connected and fixed with the fresh air duct shell 200 or with the indoor air duct shell 120. As for the connection mode, it can be a screw connection or a snap connection, which is not limited here.

Referring to FIGS. 4, 5 and 9, it is also considered that there is a fin gap at the top of the dehumidification heat exchanger 600. Since the dehumidification heat exchanger 600 is provided in the holding position, the dehumidification heat exchanger 600 is exposed to the outside. Thus, when the fresh air passes through the dehumidification heat exchanger 600, some fresh air may leak out from the fin gap at the top of the dehumidification heat exchanger 600, resulting in the loss of the fresh air. To solve this problem, a windproof 250 extends from an upper edge of the air duct outlet 202 of the fresh air duct shell 200 towards a position above the dehumidification heat exchanger 600, and covers the top of the dehumidification heat exchanger 600. The windproof 250 is integrally formed with the fresh air duct shell 200. The windproof 250 can cover the fin gap at the top of the dehumidification heat exchanger 600, so as to avoid the leakage of fresh air from the fin gap.

Referring to FIGS. 4, 5, 9 and 10, in one embodiment, a protective edge plate 260 extends laterally from a side edge of the air duct outlet 202 of the fresh air duct shell 200, and is of an L-shape and bent; a buckle groove 270 of an L-shape is provided between the protective edge plate 260 and the windproof 250; a back edge of an end plate 610 of the dehumidification heat exchanger 600 is provided with a flange 611 fitting the buckle groove 270 and plugged in the buckle groove 270. In this way, a slit can be formed between the side of the dehumidification heat exchanger 600 and the air duct outlet 202 of the fresh air duct 210, making it difficult for the fresh air to be blown out from a plug-in position of the two, so as to avoid fresh air leakage from the slit. In addition, the dehumidification heat exchanger 600 can be connected and fixed to the fresh air duct shell 200 to enhance the installation stability of the dehumidification heat exchanger 600.

During assembly, the dehumidification heat exchanger 600 can be fixed on the chassis of the housing 110 firstly, then the buckle groove 270 of the fresh air duct shell 200 is corresponded to the flange 611 of the dehumidification heat exchanger 600, and then the fresh air duct shell 200 is mounted from top to bottom, so that the buckle groove 270 of the fresh air duct shell 200 is plugged correspondingly into the flange 611 of the dehumidification heat exchanger 600, and the connection between the fresh air duct shell 200 and the dehumidification heat exchanger 600 is achieved.

In addition, in order to improve the air leakage prevention effect of the dehumidification heat exchanger 600, the dehumidification heat exchanger 600 can be abutted against the back surface of the indoor air duct shell 120, so that the front edge of the edge plate of the dehumidification heat exchanger 600 abuts against the back surface of the indoor air duct shell 120, and the slit between the dehumidification heat exchanger 600 and the side edge of the fresh air opening 121 is decreased.

Referring to FIG. 6, based on any of the above embodiments, the window air conditioner 100 also includes a fresh air grid 170 provided at the fresh air opening 121, and inclined from top to bottom towards the inner side of the fresh air opening 121. The fresh air can be dispersed by the fresh air grid 170 to mix evenly with the indoor air. The reason why the fresh air grid 170 is inclined is mainly considering that the outdoor fan 150 is provided with a water ring. When the water ring rotates to hit the water to spray to the outdoor heat exchanger 500, some water will splash on the fresh air opening 121. In order to avoid water splashing into the indoor air duct, the gaps on the fresh air grid 170 are inclined downward because the fresh air grid 170 is inclined, such that it is not easy for water droplets to drop to the gaps directly. The water droplets hitting the grid strips can be easily dripped directly under its gravity and are not prone to being adhered to the grid strips.

Referring to FIG. 7 and FIG. 8, in one embodiment, a fan mounting port 1302 is provided on the back surface of the outdoor air duct shell 130, and a vent 1301 is provided on the side surface of the outdoor air duct shell 130. The outdoor fan 150 is provided at the fan mounting port 1302. The vent 1301 is communicated with the air duct inlet 201 of the fresh air duct shell 200, so that the fresh air duct 210 and the outdoor air duct share the same outdoor fan 150. A fresh air deflector 160 is provided at the vent 1301, and the rotation of the fresh air deflector 160 can open or close the air duct inlet 201 of the fresh air duct shell 200.

Referring to FIG. 2, FIG. 9 and FIG. 10, based on any of the above embodiments, the structure of the fresh air duct shell 200 can have a variety of shapes, which are not specifically limited. Since the length of the indoor heat exchanger 400 is usually greater than that of the outdoor heat exchanger 500, the length of the indoor air duct shell 120 is usually designed to be larger, that is, the indoor air duct is relatively narrow and long. In order to fit the indoor air duct to facilitate the mixing of fresh air and indoor air of the indoor air duct, the ventilation area of the air duct outlet 202 of the fresh air duct shell 200 can be optionally designed to be greater than that of the air duct inlet 201 of the fresh air duct shell 200.

That is, the air duct inlet 201 of the fresh air duct shell 200 is smaller and the air duct outlet 202 is larger. The air duct inlet 201 is at a negative pressure relative to the high-pressure area of the outdoor air duct, and the air duct inlet 201 is small, which is conducive to the outdoor air duct to squeeze the fresh air into the fresh air duct 210, so that the fresh air entering the fresh air duct 210 has a large wind speed. When the fresh air reaches the air duct outlet 202, because the air duct outlet 202 is large, the fresh air diffuses from the air duct outlet 202 to the indoor air duct, so that the fresh air is more evenly mixed with the indoor air in the indoor air duct.

Continuing to refer to FIGS. 2, 9 and 10, it is considered that the air duct inlet 201 of the fresh air duct shell 200 is smaller than the air duct outlet 202, and a cross-section of the fresh air duct 210 needs to be changed. If the cross-section of the fresh air duct 210 changes suddenly, when the fresh air passes through the fresh air duct 210, the fresh air is prone to collision and friction at a sudden change position of the cross-section, which will produce noise.

In order to overcome improve this problem, the fresh air duct 210 is divided into an air guide section 211 and an air outlet section 212 along a flow direction of the fresh air. The air guide section 211 gradually expands from the air duct inlet 201 to the air outlet section 212. In this way, a cross-section of the fresh air duct 210 can gradually increase from the air duct inlet 201 to the air outlet section 212, and the transition is relatively smooth. In this way, the sudden change of the cross-section of the fresh air duct 210 can be improved, the wind resistance can be reduced accordingly, and large noise can be avoided.

Further, the fresh air duct shell 200 has a first side wall 220 and a second side wall 230 located on opposite sides of the air guide section 211. The second side wall 230 is close to the side plate of the housing 110, and the wall surface of the second side wall 230 is an arc shape from the air duct inlet 201 to the air outlet section 212.

For example, the first side wall 220 of the fresh air duct shell 200 is located between the back surface of the outdoor air duct shell 130 and the back surface of the indoor air duct shell 120. The first side wall 220 extends from one side of the air guide section 211 to one side of the air outlet section 212 to form a common side wall of the air guide section 211 and the air outlet section 212. The fresh air duct shell 200 is in a triangular area formed by the side surface of the outdoor air duct shell 130, the back surface of the indoor air duct shell 120 and the side plate of the housing 110. The fresh air duct shell 200 also has a third side wall 240 connected with the first side wall 220 and located on one side of the air outlet section 212. The third side wall 240 is provided in parallel with the first side wall 220.

Since the outdoor fan 150 is also provided between the back surface of the outdoor air duct shell 130 and the back surface of the indoor air duct shell 120, the first side wall 220 of the fresh air duct shell 200 has a straight plate shape to reduce the space occupied by the left side of the fresh air duct shell 200.

The triangular area has sufficient space, so that the second side wall 230 can be an arc shape from the air duct inlet 201 to the air duct outlet 202 away from the first side wall 220, so as to realize the gradual expansion of the air guide section 211 of the fresh air duct 210 and make full use of the space of the triangular area.

Referring to FIG. 11, based on any of the above embodiments, the window air conditioner 100 also includes a compressor 300 with an exhaust port 310 and an air return port 320. The window air conditioner 100 also includes a first pipe 10 connecting the exhaust port 310 of the compressor 300, the outdoor heat exchanger 500 and the indoor heat exchanger 400 in turn, and a second pipe 20 connecting the indoor heat exchanger 400 and the air return port 320 of the compressor 300, thereby forming a refrigerant circulation loop. The window air conditioner 100 also includes a first branch pipe 30 bifurcated from a junction 11 of the first pipe 10 and a second branch pipe 40 bifurcated from the second pipe 20. The first branch pipe 30 is connected with the refrigerant inlet end of the dehumidification heat exchanger 600, and the second branch pipe 40 is connected with the refrigerant outlet end of the dehumidification heat exchanger 600. The junction 11 is located between the outdoor heat exchanger 500 and the indoor heat exchanger 400.

In other words, the dehumidification heat exchanger 600 added to the window air conditioner 100 shares the compressor 300, outdoor heat exchanger 500 and pipeline components (such as the first pipe 10 and the second pipe 20) with the original refrigerant circulation loop of the window air conditioner 100, without the necessity of providing another set of refrigerant circulation system, thereby making the window air conditioner more integrated and functional.

Referring to FIG. 12, in one embodiment, in order to realize that the window air conditioner 100 has both cooling mode and heating mode, and can switch between cooling mode and heating mode, optionally, the window air conditioner 100 also includes a switcher 50 switchable between the first state and the second state. In the first state, the switcher 50 communicates the exhaust port 310 of the compressor 300 with the first pipe 10; and communicates the air return port 320 of the compressor 300 with the second pipe 20. In the second state, the switcher 50 communicates the exhaust port 310 of the compressor 300 with the second pipe 20, and communicates the air return port 320 of the compressor 300 with the first pipe 10.

When the window air conditioner 100 turns on the cooling mode, the switcher 50 is switched to the first state. The refrigerant flows from the exhaust port 310 of the compressor 300 to the first pipe 10, and firstly enters the outdoor heat exchanger 500 from the first pipe 10. After the refrigerant is liquefied to release heat (i.e., heating) in the outdoor heat exchanger 500, the liquefied refrigerant flows out of the outdoor heat exchanger 500, then enters the indoor heat exchanger 400 through the first pipe 10, and is evaporated to refrigerate in the indoor heat exchanger 400; finally, the evaporated gaseous refrigerant flows out of the indoor heat exchanger 400 and returns to the compressor 300 through the second pipe 20 and the air return port 320 of the compressor 300.

When the window air conditioner 100 turns on the heating mode, the switcher 50 is switched to the second state. The refrigerant flows from the exhaust port 310 of the compressor 300 to the second pipe 20, and first enters the indoor heat exchanger 400 from the second pipe 20. After the refrigerant is liquefied to release heat (i.e. heating) in the indoor heat exchanger 400, the liquefied refrigerant flows out of the indoor heat exchanger 400, then enters the outdoor heat exchanger 500 through the first pipe 10, and is evaporated to refrigerate in the outdoor heat exchanger 500; finally, the evaporated gaseous refrigerant flows out of the outdoor heat exchanger 500 and returns to the compressor 300 through the first pipe 10 and the air return port 320 of the compressor 300.

Continuing to refer to FIG. 12, in order to switch the fresh air dehumidification mode and the above cooling mode or heating mode, the window air conditioner 100 also includes a first opening degree adjustment device 60 and a second opening degree adjustment device 70. The first opening degree adjustment device 60 is provided on the first branch pipe 30 for opening or closing the first branch pipe 30. The second opening degree adjustment device 70 is provided in the first pipe 10 and located between the junction 11 of the first pipe 10 and the indoor heat exchanger 400 for opening or closing the pipeline between the junction 11 of the first pipe 10 and the indoor heat exchanger 400. The window air conditioner 100 also includes a flow direction adjustment device 80 for adjusting an unidirectional flow of refrigerant from the dehumidification heat exchanger 600 to the second pipe 20.

When the window air conditioner 100 is in the aforementioned cooling mode or heating mode, the first opening degree adjustment device 60 is closed and the second opening degree adjustment device 70 is opened.

When the window air conditioner 100 starts the fresh air dehumidification mode, the switcher 50 is switched to the first state, the first opening degree adjustment device 60 is opened and the second opening degree adjustment device 70 is closed. The refrigerant flows from the exhaust port 310 of the compressor 300 to the first pipe 10, and firstly enters the outdoor heat exchanger 500 from the first pipe 10. After the refrigerant is liquefied to release heat (i.e., heating) in the outdoor heat exchanger 500, the liquefied refrigerant flows out of the outdoor heat exchanger 500, then enters the dehumidification heat exchanger 600 through the first pipe 10 and the first branch pipe 30, and is evaporated to refrigerate in the dehumidification heat exchanger 600 for dehumidification of the dehumidification heat exchanger 600; finally, the evaporated gaseous refrigerant flows out of the dehumidification heat exchanger 600 and returns to the compressor 300 through the second branch pipe 40 and the air return port 320 of the compressor 300.

The first opening degree adjustment device 60 and/or the second opening degree adjustment device 70 may be an on-off valve, a solenoid valve or other structure with a control pipeline switching function. The flow direction adjustment device 80 may be a check valve.

Continuing to refer to FIG. 13, in other embodiments, a refrigerant radiator 90 can be provided on the pipeline between the outdoor heat exchanger 500 and the junction 11 of the first pipe 10. The refrigerant radiator 90 can reduce the temperature of the electric control system and ensure the safety of the electric control system.

The above is only the preferred embodiment of the present application and does not limit the scope of the patent of the present application. Under the inventive concept of the present application, any equivalent structural transformation made by using the contents of the description and drawings of the present application, or directly/indirectly applied in other relevant technical fields, are included in the scope of patent protection of the present application.

The invention claimed is:

1. An air conditioner comprising:
- an indoor air duct shell forming:
  - a fresh air opening; and
  - an indoor air duct communicating the fresh air opening, an indoor air inlet, and an indoor air outlet;
- an outdoor air duct shell comprising:
  - an air duct back plate; and
  - air duct side plates extending obliquely from two sides of the air duct back plate, respectively, wherein:
    - one of the air duct side plates is convex and forms a vent and forms a sleeve part along an outer periphery of the vent; and
    - the outdoor air duct shell forms an outdoor air duct communicating the vent, an outdoor air inlet, and an outdoor air outlet; and
- a fresh air duct shell forming a fresh air duct communicating the vent of the outdoor air duct shell and the fresh air opening of the indoor air duct shell, wherein the sleeve part of the outdoor air duct shell is sleeved on a fresh air duct inlet of the fresh air duct shell.

2. The air conditioner according to claim 1, further comprising at least one fresh air deflector provided at the vent of the outdoor air duct shell that is rotatably adjustable.

3. The air conditioner according to claim 2, wherein:
- the at least one fresh air deflector comprises a plurality of fresh air deflectors that are switchable between an unfolded state and a closed state by rotation;
- in the unfolded state, a ventilation gap is formed between two adjacent fresh air deflectors to open the vent; and
- in the closed state, the plurality of fresh air deflectors are spliced in turn to cover the vent.

4. The air conditioner according to claim 2, wherein:
the air conditioner further comprises a motor configured to rotate the at least one fresh air deflector; or
the at least one fresh air deflector is configured to rotate by airflow through the vent.

5. The air conditioner according to claim 1, wherein:
the air duct back plate forms a fan mounting port;
the air conditioner further comprises an outdoor fan provided at the fan mounting port; and
the vent is disposed between the outdoor fan and the outdoor air outlet.

6. The air conditioner according to claim 1, further comprising a compressor provided between another air duct side plate of the air duct side plates of the outdoor air duct shell and an end of the indoor air duct shell.

7. The air conditioner according to claim 6, wherein the air conditioner further comprises:
an indoor heat exchanger provided within the indoor air duct; and
an outdoor heat exchanger provided within the outdoor air duct.

8. The air conditioner according to claim 7, further comprising a dehumidification heat exchanger provided within the fresh air duct.

9. The air conditioner according to claim 8, wherein:
the compressor has an exhaust port and a return port; and
the air conditioner further comprises:
one or more first pipes connecting the exhaust port of the compressor, the outdoor heat exchanger, and the indoor heat exchanger in turn;
a second pipe connecting the indoor heat exchanger and the return port of the compressor; a first branch pipe connecting a refrigerant inlet end of the dehumidification heat exchanger to one of the first pipes between the outdoor heat exchanger and the indoor heat exchanger; and
a second branch pipe connecting a refrigerant outlet end of the dehumidification heat exchanger with the second pipe.

10. The air conditioner according to claim 9, wherein:
the air conditioner further comprises a switcher switchable between a first state and a second state;
in the first state, the switcher communicates the exhaust port of the compressor with one of the first pipes and communicates the return port of the compressor with the second pipe; and
in the second state, the switcher communicates the exhaust port of the compressor with the second pipe and communicates the return port of the compressor with one of the first pipes.

11. The air conditioner according to claim 10, further comprising:
a first opening degree adjustment device provided on the first branch pipe; and/or
a second opening degree adjustment device provided on one of the first pipes between the first branch pipe and the indoor heat exchanger.

12. The air conditioner according to claim 1, further comprising a dehumidification heat exchanger provided: inside the fresh air duct shell, between an air duct outlet of the fresh air duct shell and the fresh air opening, at the fresh air opening, or on an inner side of the fresh air opening.

13. The air conditioner according to claim 12, further comprising a holding position formed between the air duct outlet of the fresh air duct shell and the fresh air opening, wherein the dehumidification heat exchanger is provided in the holding position.

14. The air conditioner according to claim 13, wherein a portion of the fresh air duct shell extends from an upper edge of the air duct outlet of the fresh air duct shell above the dehumidification heat exchanger and covers a top of the dehumidification heat exchanger.

15. The air conditioner according to claim 14, further comprising:
a protective edge plate extending laterally from a side edge of the air duct outlet, wherein the protective edge plate is of an L-shape and bent; and
a buckle groove provided between the protective edge plate and the portion of the fresh air duct shell, wherein the buckle groove is of an L-shape,
wherein a back edge of an end plate of the dehumidification heat exchanger is provided with a flange fitting plugged in the buckle groove.

16. The air conditioner according to claim 12, wherein a ventilation area of the air duct outlet of the fresh air duct shell is greater than that of an air duct inlet of the fresh air duct shell.

17. The air conditioner according to claim 16, wherein:
the fresh air duct is divided into an air guide section and an air outlet section along a flow direction of fresh air; and
the air guide section expands from the air duct inlet to the air outlet section.

18. The air conditioner according to claim 17, wherein:
the fresh air duct shell has a first side wall and a second side wall located on opposite sides of the air guide section; and
a wall surface of the second side wall is in an arc shape from the air duct inlet to the air outlet section.

19. The air conditioner according to claim 12, further comprising a fresh air grid provided in the fresh air opening and inclined from top to bottom towards the inner side of the fresh air opening.

* * * * *